United States Patent [19]

Haueter

[11] Patent Number: 5,016,546

[45] Date of Patent: May 21, 1991

[54] DEVICE FOR THE INSERTION, STORAGE, AND REMOVAL OF OBJECTS TO BE STORED IN STRONGBOXES AND OF SHEET-LIKE MATERIAL

[75] Inventor: Ernst Haueter, Bowil, Switzerland

[73] Assignee: Ascom Autelca AG, Gumligen, Switzerland

[21] Appl. No.: 311,734

[22] Filed: Feb. 17, 1989

[30] Foreign Application Priority Data

Mar. 10, 1988 [CH] Switzerland ..... 911/88

[51] Int. Cl.[5] ..... E05G 1/00

[52] U.S. Cl. ..... 109/45; 109/47; 109/55; 109/66

[58] Field of Search ..... 109/45–49, 109/53–55, 24.1, 66

[56] References Cited

U.S. PATENT DOCUMENTS

| | | | |
|---|---|---|---|
| 1,506,491 | 8/1924 | Kline | 109/46 |
| 2,770,516 | 11/1956 | Mestre | 109/55 X |
| 2,963,333 | 12/1960 | Mestre | 109/24.1 |
| 3,078,789 | 2/1963 | McGee | 109/24.1 |
| 3,683,826 | 8/1972 | Rieckmann | 109/46 |
| 3,836,980 | 9/1974 | Grosswiller et al. | 109/66 X |
| 4,164,179 | 8/1979 | McLaughlin et al. | 109/24.1 X |
| 4,227,757 | 10/1980 | Ringe et al. | 109/47 X |
| 4,308,804 | 1/1982 | Guibord et al. | 109/24.1 |
| 4,423,826 | 1/1984 | Hirata et al. | 109/24.1 X |
| 4,483,255 | 11/1984 | Collier et al. | 109/66 |
| 4,597,340 | 7/1986 | Huckle | 109/45 |
| 4,655,368 | 4/1987 | Bateman et al. | 109/45 X |
| 4,669,393 | 6/1987 | Wuthrich | 109/47 X |
| 4,726,474 | 2/1988 | Arikawa et al. | 109/24.1 X |
| 4,755,011 | 7/1988 | Seroka et al. | 109/47 X |

*Primary Examiner*—Gary L. Smith
*Assistant Examiner*—Suzanne L. Dino
*Attorney, Agent, or Firm*—Brady, O'Boyle & Gates

[57] ABSTRACT

The device, fashioned, for example, as a cashier's safe (3), has two openings (12) for the issuance of paper currency (2) and valuable objects, stored in strongboxes (1), from the interior (4) of the safe. A pivotable member equipped with conveying means takes over the strongboxes (1) and, respectively, the bills (2) from respectively one conveyor arranged in the interior (4) of the safe and pushes them through one of the openings (12). After having been emptied or loaded, the strongboxes (1) are again retracted by the member and transferred to the conveyor (23).

10 Claims, 5 Drawing Sheets

Figure 1:
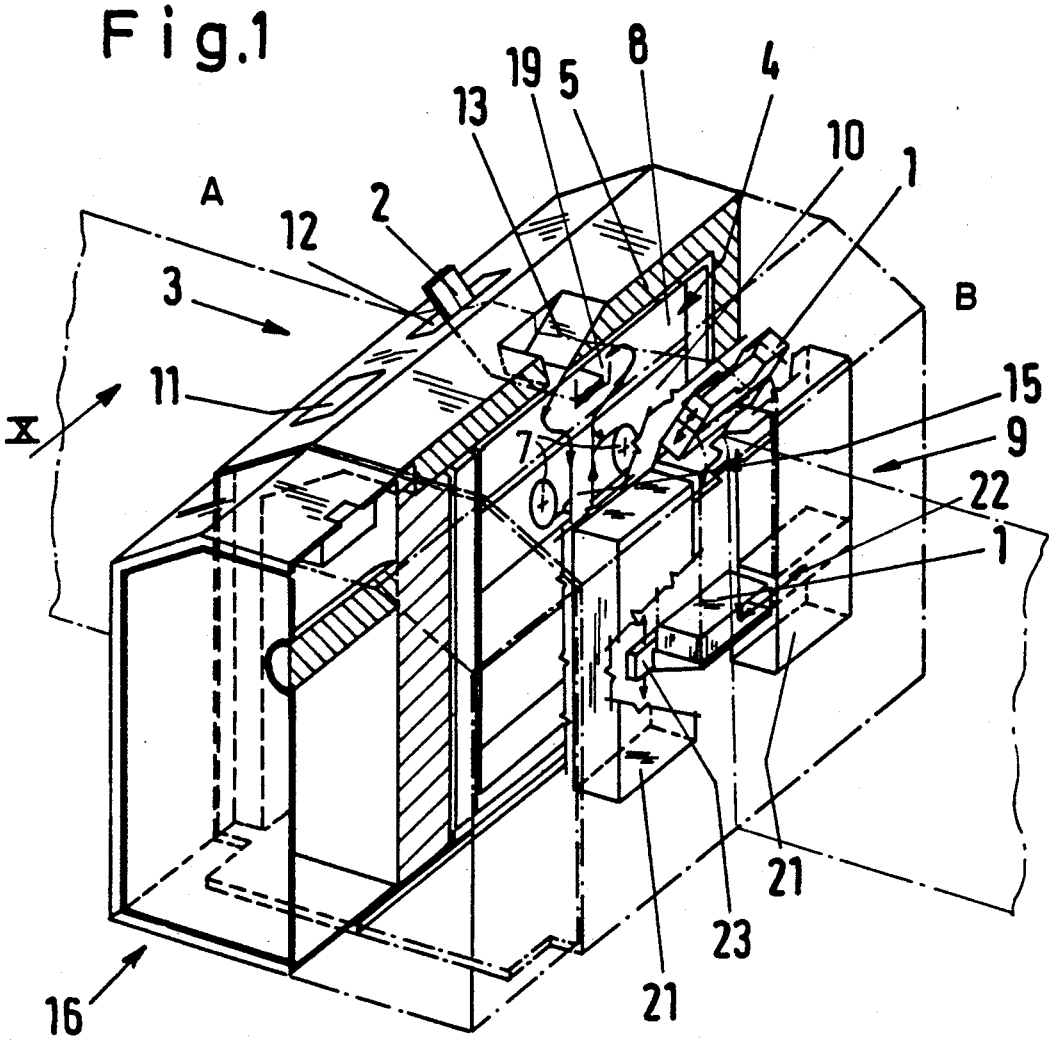

DEVICE FOR THE INSERTION, STORAGE, AND REMOVAL OF OBJECTS TO BE STORED IN STRONGBOXES AND OF SHEET-LIKE MATERIAL

The invention relates to a device for the insertion, storage, and removal of objects to be stored in strongboxes.

A device for the insertion, storage, and removal of objects to be stored in strongboxes and of sheet-like material is indicated in all those cases where sheet-like material, as well as small components not in sheet form, or entire bundles of sheet-like material are to be protected from forcible seizure or environmental influences. A device of this type has been described in EP-A 0,182,137. The device involves a cashier's safe utilized at teller's windows of financial institutions, for example banks, and is designed so that relatively large amounts can be withdrawn only at a delay from an armored interior of a safe with the aid of conveying mechanisms. The conventional cashier's safe exhibits two separate openings for the insertion and removal of paper currency, for example the currency of the particular country, and of strongboxes capable of storing, for example, bundles of paper money or other currencies, coins, jewelry, and other similar items. The cashier's safe can be set up between two teller's windows. Each teller can control, with his terminal, only storage units and storage sites assigned to him.

In case customers are located at both windows, it is readily possible that the deposits and, respectively, withdrawals are confused by the two tellers. Such confusion is signaled, on the one hand, during the depositing step by the cashier's safe as an error, and detected by the respective teller during the withdrawal step, but leads to unpleasant delays and possibilities of making mistakes. If, during the insertion of the bundles of paper money, an erroneous deposit is determined by the cashier's safe, for example on account of banknotes that have stuck together, then no immediate reissuance is possible in case of the existing system; the cashier's safe is blocked.

The invention is based on the object of providing a device permitting the storage of objects that can be held in strongboxes and of sheet-like material in a space-saving and rapid fashion under secure conditions, and allowing the issuance of strongboxes and sheet-like material to a joint location.

The advantages attained by the invention are to be seen essentially in that respectively one operator can only withdraw sheet-like material and strongboxes assigned to him at a joint device, and, in a preferred embodiment, the strongbox as well as the sheet-like material are extended from an opening to such an extent that they can be seized in an ergonomically satisfactory way.

Preferably, the strongbox, the weight of which is significantly larger than that of the sheet-like material, is maintained during seizure by a conveyor as well as in the delivery position in respectively one mechanical dead center position of the pivoting mechanism of a pivotable member in a self-locking fashion and/or in the immediate vicinity of a dead center position. On account of this location of the dead center positions, a gentle and nowise jerky start-up of the pivotable member of the device is obtained. By the pivotable member, the strongbox stemming from different conveyors and the sheet-like material can be brought exactly to the opening. Due to this exact positioning, the opening can be designed with minimum dimensions. This small opening is significantly safer from outside interventions, and furthermore can be sealed more effectively against usage of force than a large opening.

Another advantage is to be seen in that the issued sheet-like material and the strongboxes are unequivocally assigned to respectively one teller, and mix-ups leading to unpleasantness and time delays are no longer possible.

The embodiment according to claim 1 contains the especially advantageous feature that bills that have been recognized as flawed, are sticking together, or are poorly identifiable can be immediately reissued.

Figure 2:
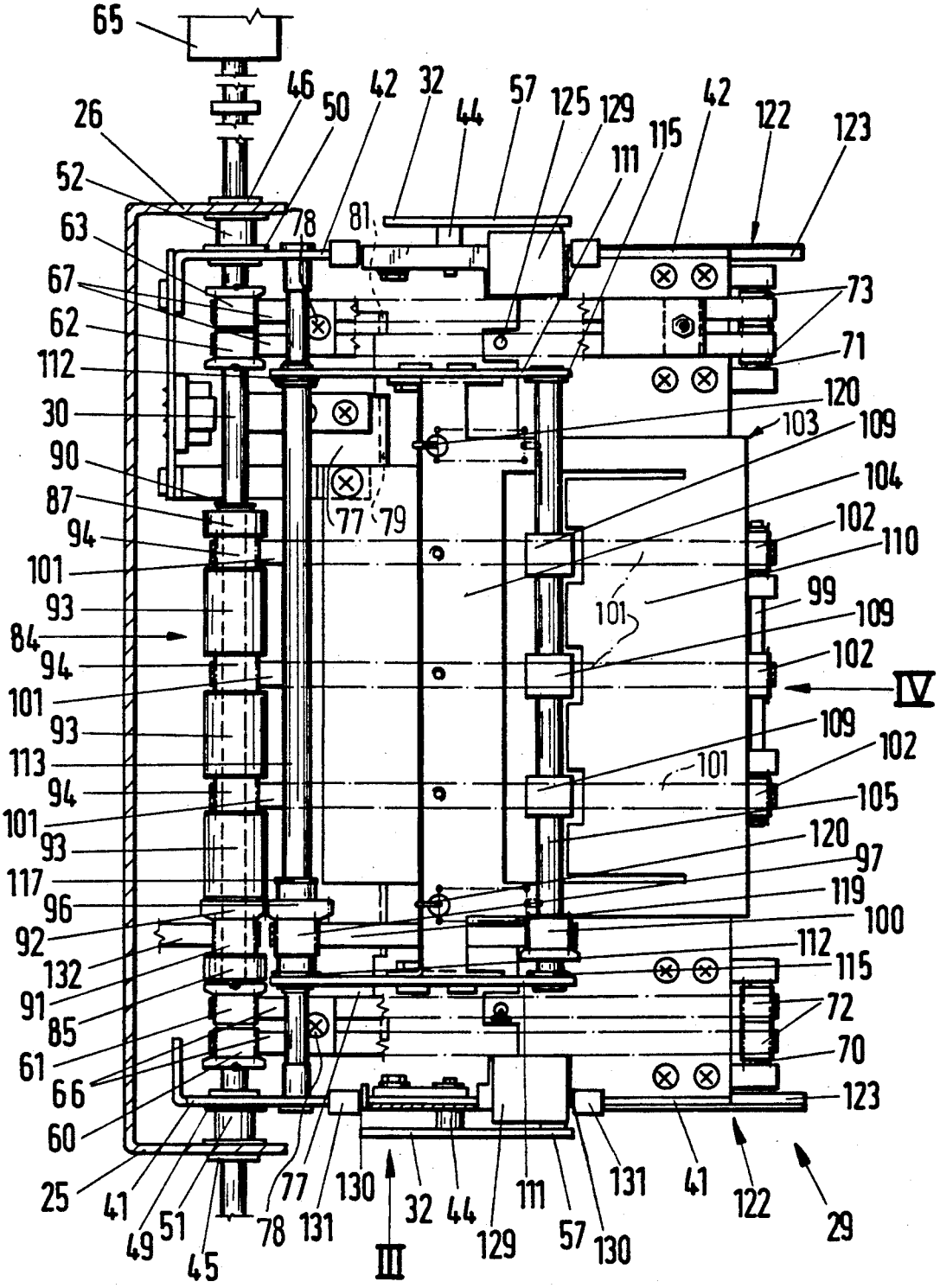
Figure 4:
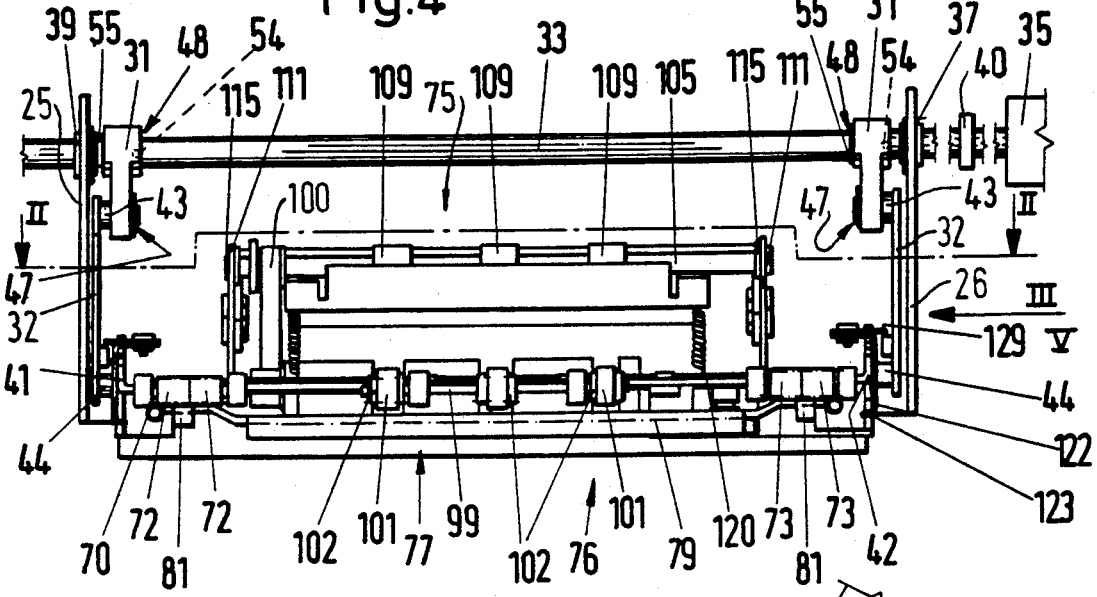
Figure 3:
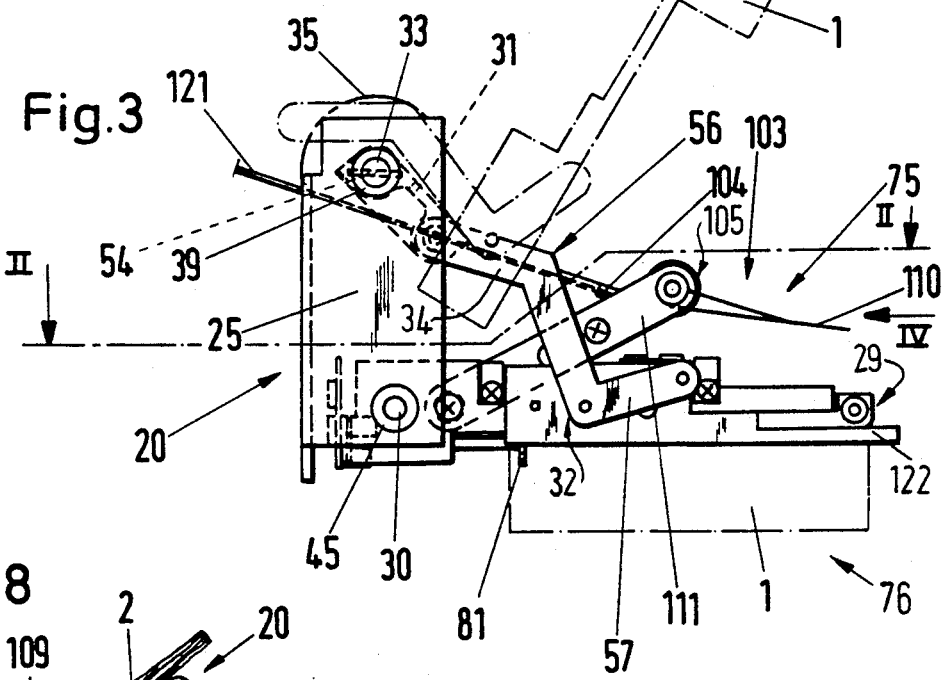

One embodiment of the device according to this invention will be described below in greater detail with reference to the drawings wherein:

FIG. 1 is a perspective view, partially in section, of a device designed as a cashier's safe, FIG. 2 is a horizontal sectional view through a unit of the cashier's safe taken substantially along the line II—II in FIGS. 3 and 4, showing the pivotable, plate-shaped member is in a horizontal position and with the gear belts being only partly shown for the sake of simplicity and clarity.

Figure 9:
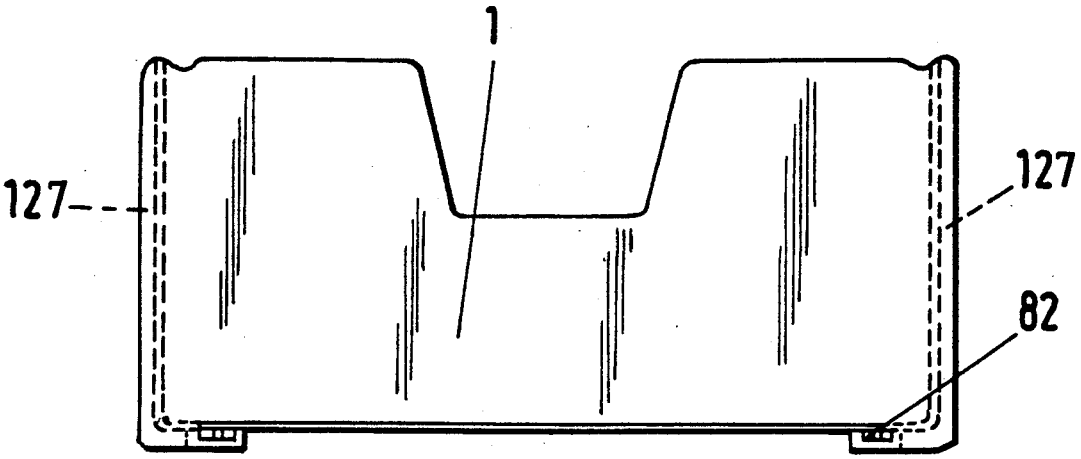
Figure 8:
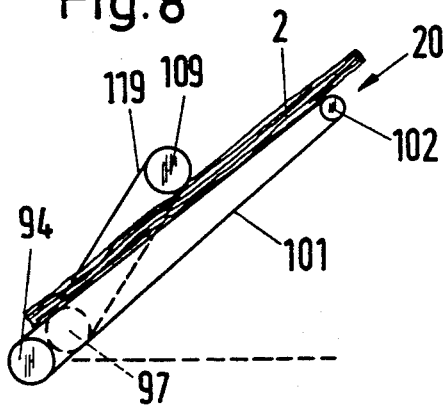
Figure 5A:
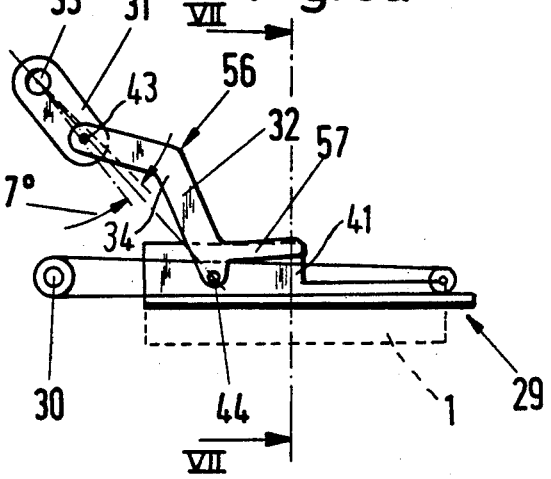
Figure 5B:
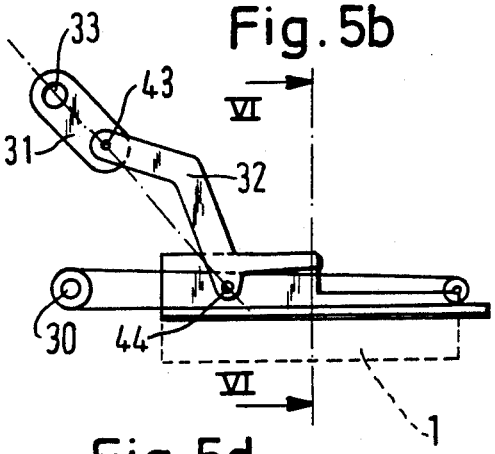
Figure 5C:
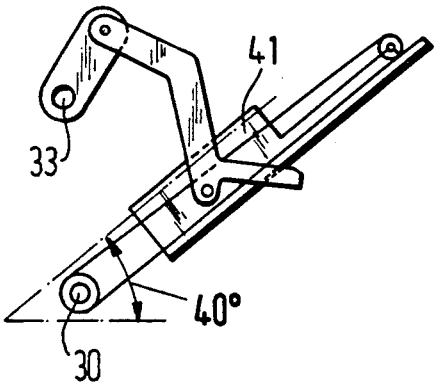
Figure 5D:
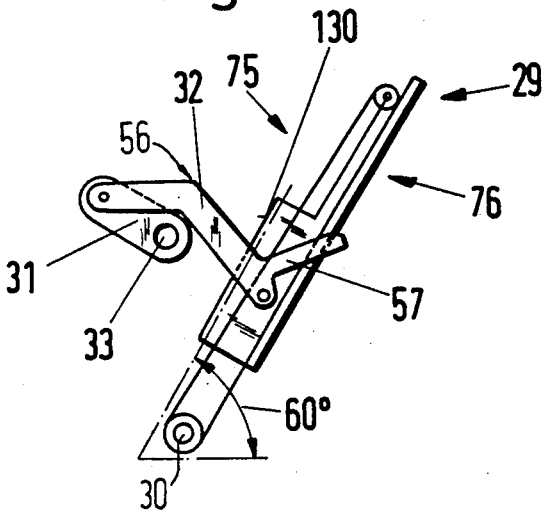
Figure 6:
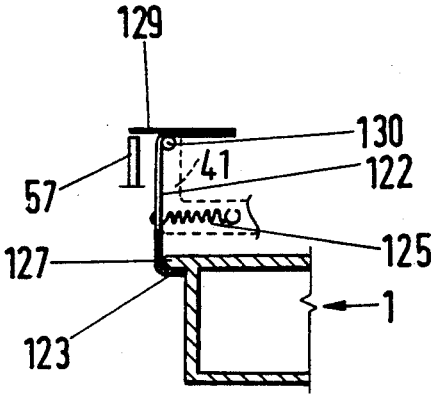
Figure 7:
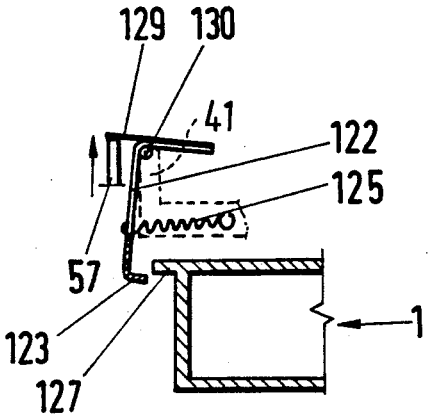
Figure 10:
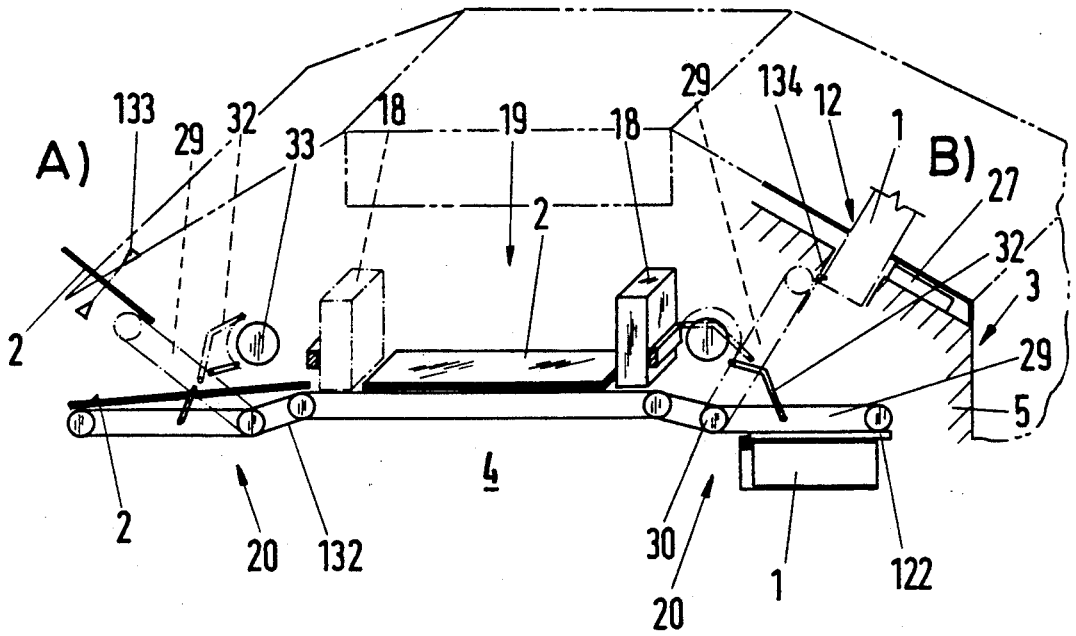

FIG. 3 shows a lateral view in the direction III in FIG. 2, of the unit with the member in horizontal position and, in dot-dash lines, in the issuing position for the objects in the strongbox, FIG. 4 shows a front view of the unit in the viewing direction IV in FIG. 2, FIGS. 5*a*, 5*b*, 5*c*, and 5*d* show simplified diagrammatic views of the lateral view of the unit shown in FIG. 3 demonstrating the different pivoting positions of the member, FIG. 5*a* showing it in the horizontal position, where the guide rail for the strong box is opened, FIG. 5*b* showing it in the horizontal position with the guide rail being closed, FIG. 5*c* showing it in an inclined position of approximately forty degrees where it is possible to issue paper currency, FIG. 5*d* showing it in an inclined position of approximately sixty degrees for the insertion and removal of the objects in and, respectively, out of the strongbox, FIG. 6 is a diagrammatic view of the guide rail in the closed position taken substantially along the line VI—VI in FIG. 5*b*, FIG. 7 is a diagrammatic view of the guide rail in the opened position taken substantially along the line VII—VII in FIG. 5*a*, FIG. 8 is a diagrammatic view of the gear belts of the pivotable, plate-shaped member for transportation of the paper currency through an opening of the cashier's safe shown in the inclined position of FIG. 5*c*, FIG. 9 is a view of one of the strongboxes from the top, and FIG. 10 is a diagrammatic, cross-sectional view through the cashier's safe taken substantially along the viewing plane X in FIG. 1 showing two openings for insertion and removal of paper currency and objects in strongboxes and an insert opening for the insertion of paper currency.

The device for the insertion, storage, and removal of objects that can be stored in strongboxes 1 and of sheet-like material 2 is designed as a cashier's safe 3 illustrated in FIG. 1 with a partial section through its safe interior 4 and its armor 5. In the interior 4 of the safe, there are stored, in a strongbox storage means 9, strongboxes 1 with, for example, hard currency, paper money, individually or in bundles, of foreign currency, special coins, jewelry, or valuable documents, and, on several, not directly shown (because they do not form part of the invention), reels of a roller-type storage means 10, paper money 2 in the shape of sheet-like material separately in accordance with currency and value. The roller-type storage means 10 can be designed in correspondence with the storage facility described in European Patent Application 88103427.6, not pertaining to the state of the art.

The cashier's safe 3 is normally set up between two teller's windows and is jointly operated by two tellers A, B, as indicated in FIGS. 1 and 10. Each teller has on his side a terminal 11 for data input for a control system, not shown, in the safe door 16 for the cashier's safe 3, and an insertion and removal opening 12 for the objects stored in the strongboxes 1 and for the paper money 2. The insertion of the paper money 2 takes place for both tellers jointly through an insert opening 13 in the middle of the surface of the cashier's safe 3. The paper money 2 introduced into the opening 13 is separated by a separating mechanism, not shown, checked by means of a testing unit, not shown (particularly for sticking together, optionally also for being genuine), and stored via a conveyor 15 in the roller storage means 10. The strongboxes 1 are disposed in the strongbox storage unit 9. The separating mechanism, testing unit, control system, conveyor 15, roller storage means 10, and strong box storage means 9 are not shown directly, because they do not form part of the invention.

The introduction, storage, and issuance are regulated by the control system, the terminal 11 of which can be seen in FIG. 1 on the topside of the cashier's safe 3, and this is also done for the composition of the bills 2 into a bank note bundle 2, starting from the roller storage means 10. The bill or bills 2 is or are retrieved from the roller storage means 10 by the conveyor 15 and deposited in a collection box 19. From this collection box 19, the bundle 2 is pushed, as shown schematically in FIG. 10, depending on whether it is intended for teller A or B, by means of a conveyor designed as a pusher 18 to a right-hand or left-hand unit 20 in the interior 4 of the safe. The unit 20 takes over the bill bundle 2 and pushes it through the right-hand or left-hand opening 12 for withdrawal by the respective teller.

The operation of one of the two, identically constructed units 20, which are positioned below the insertion and removal openings 12, is described hereinbelow.

The strongbox storage means 9 has, for the strongboxes 1, two internal storage chambers 21 (the storage places are shown in FIG. 1 with dashed lines), (a horizontal cross feed means 22, and a lifting means 23 for vertical transport. A strongbox 1 selected by the control system is pushed by way of the cross feed means 22 from its station in one of the two storage chambers 21 to the lifting means 23, raised by the latter to the unit 20, and taken over by this unit as described below, and subsequently conveyed through the opening 12 where its contents are withdrawn by teller B. Then the strongbox 1 is either filled again, for example with bills 2, or bill bundles, hard currency, etc., or retracted empty through the opening 12 and returned to its original station in one of the storage chambers 21. The selection of the strongboxes 1 from their storage places will not be explained, because this does not form part of the invention.

The unit 20 utilized for the issuance of bank note bundles 2, as well as for the accommodation and moving of the strongbox 1 is illustrated in a top view in FIG. 2 and in respectively one lateral view in FIGS. 3 and 4. The unit 20 is attached by means, of a right-hand and left-hand flange 25 and 26 to a not directly shown carrier 8 (FIG. 1) that can be pulled out of the interior 4 of the safe.

In order to make it possible for the bill bundles 2 as well as the strongbox 1 to be guided through the opening 12, which is kept small for security reasons, and lie there ready to be seized by the teller, the bill bundles 2 and the strongboxes 1 are brought by way of a pivotable, plate-shaped member 29 of the unit 20 directly below the opening 12 and then pushed through the latter, as is shown diagrammatically in FIG. 10. The opening 12 is opened solely during issuance. The remaining time the opening is sealed by a slide 27. Pivoting of the member 29, as shown in FIG. 3 as well as FIGS. 5*a* to 5*d*, takes place about a pivot axle 30 by means of respectively two cranks 31 and respectively two angle levers 32, the two cranks 31 being nonrotationally mounted to a drive shaft 33. The drive shaft 33 is turned by a motor 35 fixed to the flange 26. As illustrated in FIG. 4, the drive shaft 33 is located above and in parallel to the pivot axle 30 and is supported by respectively one bearing 37 and 39 in the flanges 25 and 26 of the unit 20. The drive shaft 33 and the motor 35 are connected by way of a coupling means 40. Each of the two other angle levers 32 is pivotably supported by means of bolts 43 and 44 forced into the levers at the end of the crank 31 and approximately in the center of respectively one upwardly bent outer side edge 41 and 42 of the member 29. The bolts 43 and 44 are secured by spring rings from sliding out of a bore 47 of the crank 31 and, respectively, out of the rims 41 and 42. The pivot axle 30 extends horizontally and is likewise rotatably held at each of the flanges 25 and 26 by a bearing 45 and 46. The member 29 is pivotably supported on the axle 30 by respectively one bearing 49 and 50 in the rearward extension of its edges 41 and 42; see FIG. 2, where, for avoiding an overburdening of this drawing, a section view through the unit 20 without the drive shaft 33, the coupling means 40, the crank 31, . . . , is shown. The pivot axle 30 is thus freely rotatably supported in the flanges 25 and 26, and furthermore the member 29 is supported freely rotatably on the pivot axle 30. The bearings 45 and 49, as well as 46 and 50 are spaced apart by respectively one spacer sleeve 51 and 52. The spacer sleeves 51 and 52 space and position the member 29 laterally with respect to the two flanges 25 and 26.

The cranks 31 exhibit the bore 47 at one end and a bore 48 at the other end; see FIG. 4. The bore 47 accommodates the bolt 43, and the drive shaft 33 is seated in bore 48. A notch that is opening toward the bore 48 but limited radially in the outward direction is arranged radially to the bore 48 at one of its orifices in the surface thereof. A pin 54, passed through the drive shaft 33, is located in this notch, as indicated in FIGS. 3 and 4. The pin 54 serves for power transmission from the drive shaft 33 to the crank 31. Migration of the pin 54 out of the notch of crank 31 is prevented by a spring ring 55 seated in a groove of the drive shaft 33 and pressing against the crank 31; the radial termination of the notch makes radial slipping out of the pin 54 impossible.

Each toggle lever 32 has a leg portion 34 with an upwardly oriented knee 56 about in its center, the legs of the knee forming, in the back of the knee, an angle of approximately one hundred and thirty degrees. One leg of the knee, as described above, is supported with a bolt 43 rotatably at the crank 31, and the other leg is supported rotatably by way of a further bolt 44 and secured by a spring ring approximately in the middle of the edge 41 and 42, respectively, of the member 29. A leg 57 extends approximately under a right angle in the direction of the knee 56 from the end of the toggle lever 32 supported by means of pin 44 in member 29.

At a spacing of a few millimeters from the bearings 49 and 50 within the member 29, respectively two gear belt wheels 60, 61, 62 and 63 are disposed, as shown in FIG. 2 on the pivot axle 30 and are connected to the latter by pins in a nonrotational fashion. The pin connection is effected analogously to the crank 31 on the drive shaft 33. The gear belt wheels 60–63 are driven by a motor 65 via the pivot axle 30.

Respectively one axle 70 and 71, with respectively two gear belt wheels 72 and 73, is arranged, held by respectively two bearing blocks, at the two edges of the side of member 29 lying in opposition to the pivot axle 30, as shown in FIG. 2. The gear belt wheels 72 are joined by a pair of gear belts 66 with the gear belt wheels 60 and 61 on the pivot axle 30, and the gear belt wheels 73 are joined by a pair of gear belts 67 with the gear belt wheels 62 and 63 also on the pivot axle 30. The four gear belts 66 and 67 travel over the topside 75 of member 29 and back again by way of the underside 76; see FIG. 4.

On the underside 76, a slide 77 is clamped with clamping means 78 at its outer edges respectively to one of the gear belt pairs 66 and 67 in such a way that the slide can be shifted in parallel to the pivot axle 30 across the underside 76. Above the clamping means 78 the parts of the gear belt pair 66 and 67 running on the topside 75 are broken away and not shown, so as to be able to show the clamping means 78 in FIG. 2.

On the side facing the pivot axle 30 an angled extension 79 extends symmetrically to the lateral center over about eighty percent of the width of the slide 77, this extension serving for pushing the strongbox 1, as explained below, through the opening 12. Respectively one angled gripper 81 is located at the same level as the extension 79 on the outer edges of the slide 77, as shown in FIGS. 2, 3, and 4. An eye 82 at the lower outer edge of the strongbox 1, as illustrated in FIG. 9, engages into each of the grippers 81 for retracting the strongbox 1.

A shaft 84 hollow on the inside is placed over the pivot axle 30, as shown in FIG. 2. Respectively one spacer disk 85 and 87 is arranged on the pivot axle 30 on each side of the shaft 84. The shaft 84 is fixed in its position by a spring ring 90 in a groove of the pivot axle 30 on the side pointing toward the gear belt wheel 62, and toward the opposite side the spacer disk 85 directly abuts the gear belt wheel 61. The shaft 84 has a gear belt wheel 91 and a gear wheel 92 on the side adjoining the spacer disk 85, and following the gear wheel 92, a spacer sleeve 93 and a gear belt wheel 94, alternatingly three times in succession.

The three gear belt wheels 94 lie approximately symmetrically to the center of the member 29. Three gear belts 101 travel over these wheels on the topside and bottom side 75 and 76. On the side of member 29 in opposition to the pivot axle 30, the gear belts 101 are rerouted by three gear belt wheels 102 on a shaft 99.

Above the topside 75, a holddown means 103 is arranged, as shown in FIGS. 2 and 3. The holddown means 103 has a bracket 104, a shaft 105 parallel to the pivot axle 30 with a gear belt wheel 100 with pin connections analogously to the crank 31, and three elastic conveyor rollers 109 which come to lie, during the pivoting operation described further below, directly above the gear belts 101, which are shown at the topside 75 with dashed lines and a spring plate 110. The spring plate 110 is welded to the side of the bracket 104 facing away from the pivot axle 30. The bracket 104 is threaded to two rails 111 approximately in the center of the latter. The rails 111 are supported pivotably on an axle 113 by means of respectively one bearing 112; this axle is connected, at the same level as the pivot axle 30 and parallel thereto, rigidly to the edges 41 and 42. On the other end of the rail 111, the shaft 105 is retained in respectively one bearing 115, as shown in FIG. 4. The gear belt wheel 100 is disposed beside one of the rails 111 within the holddown means 103. The bracket 104 forms with each rail 111 an angle of approximately thirty degrees, the apex of the angle pointing toward the shaft 105. A gear belt wheel 97 and a gear wheel 96 travel on the axle 113, these wheels being prevented from lateral migration on one end face by one of the rails 111 and on the other side by a clamping ring 117. The gear belt wheel 97 and the gear wheel 96 are joined together and rotate slipping on the axle 113.

The gear wheel 92 on shaft 84 directly drives the gear wheel 96 and the gear belt wheel 97. A gear belt 119, whose course above the topside 75 is not shown for the purpose of not overloading the drawing, travels over the gear belt wheel 97 to the gear belt wheel 100. Translation via the gear wheels 92, 96, the gear belt wheel 97, the gear belt 119, and the gear belt wheel 100 to the conveyor rollers 109 serves for allowing the conveyor rollers 109 to run at the same peripheral speed as the gear belts 101. Respectively one draw spring 120 is arranged between the top edge of the bracket 104 and of the member 29 at a spacing of several millimeters from the rail 111, this spring pulling the holddown means 103 toward the member 29, as shown in FIG. 4. A plastic strap 121 is likewise attached with one of its ends to the top edge of the bracket 104, causing the holddown means 103 to be at a distance of several millimeters from the member 29, as shown in FIG. 3, against the force of the two springs 120 in the horizontal position of the member 29. The other end of the plastic strap 121 is connected to the carrier 8 (not shown). As shown in FIG. 3, the length of the plastic strap 121 is chosen so that the holddown means 103 is elevated from the member 29, when it is in a horizontal position.

Respectively one guide rail 122 for the strongbox 1 is arranged on the outside of the edges 41 and 42, respectively. The two guide rails 122 are in mirror-image relationship to each other. As shown in FIGS. 6 and 7 are of such a shape that they have respectively one extension 123 at their parts lying on the underside 76 of member 29, the two extensions pointing toward each other in parallel to the member 29. Each of the guide rails 122 is pulled by respectively one spring 125 to the respective edge 41, 42, see FIG. 2 and dashed lines in FIGS. 6 and 7. Respectively one extension 129 points away from the member 29 at the top edge of the guide rail 122. Respectively one pin-shaped projection 130 is fashioned as an axle, likewise at the top edge of the guide rail 122 in the longitudinal direction thereof; this axle is seated in a synthetic resin bearing block 131 (see FIG. 2), preferably made of "Delrin". The synthetic resin blocks 131 are threaded to the edges 41 and 42. The bolt 44 of the toggle lever 32 in the edges 41 and 42 extends through respectively one (not shown) aperture of the guide rails 122 A pivotal movement of each guide rail 122 thus is not impeded by the bolts 44.

The strongboxes 1 are constituted by an inwardly hollow, rectangular parallelepiped open on one of its longitudinal sides. As illustrated in FIG. 9, respectively one of the eyes 82 is formed on the side in opposition to the open longitudinal side, in the proximity of the edge toward the broad sides and in the direct vicinity to one of the top surfaces. A protuberance or flange 127 extends subsequently to each of the eyes 82 along the respective lateral surface.

The strongbox 1, as indicated in FIGS. 6 and 7, is held on its protuberance 127 by the extension 123 of the guide rail 122, seized thereby, and slides thereon, as will be described further below.

The motion sequences will be described in greater detail below.

For receiving the bundle 2 of paper currency from the collection box 19, the pivotable member 29 is in the horizontal position as illustrated in FIG. 5*b* and FIG. 10 at the right side. In the horizontal position, the fulcrum with the bolt 43 of the angle lever 32 and the crank 31 lies slightly above the connecting line of the center of the drive shaft 33 and the center of bolt 44, i.e. the pivoting mechanism with crank 31 and toggle lever 32 is just barely away from reaching its bottom dead center position. The holddown means 103 is lifted off the member 29 by the synthetic resin strap 121 so that the bill bundle 2, pushed by the pusher 18 from the collection box 19 to the topside 75 of the member 29 is not impeded. A gear belt 132 is connected with the conveyor 18 by way of a slipping clutch, not shown, and drives the axle 84 via the gear belt wheel 91. The axle 84 drives the gear belts 101 via the three gear belt wheels 94, and via the gear wheel 92, the gear wheel 96 with the gear belt wheel 97 and also, with the gear belt wheel 97 and the gear belt 119, the axle 105 with the three conveying rollers 109 The conveying speed of the bundle 2 of bills coincides with the speed of the gear belts 101 and with the peripheral speed of the three elastic rollers 109. The movement is arrested once about twenty percent of the length of the bills has passed through below the conveying rollers 109. The member 29 is pivoted about the pivot axle 30 upwardly toward the axle 33 by the motor 35, the drive shaft 33, the crank 31, and the toggle lever 32. After a pivoting of approximately ten degrees from the horizontal, the holddown means 103 contacts, with its spring plate 110, the bill bundle 2 lying on the member 29. After another approximately ten degrees, the conveyor rollers 109 likewise exert pressure on the bill bundle 2; the plastic strap 121 is now totally released. The bill bundle 2 is at this point in time fixedly clamped in place, and the pivoting action is continued up to an angle of forty degrees from the horizontal, as illustrated in FIG. 5*c*, until the upper end of the bill bundle 2 is directly underneath the opening 12. The drive mechanism via the gear belt 132 is again initiated, and the bill bundle 2 is pushed through the opening 12 until it has just barely passed the conveying rollers 109 but is still perfectly held by the spring plate 110 of the holddown means 103. The bill bundle 2 now extends from the opening 12 in a position wherein it can be readily grasped by the teller, and can be withdrawn. In this inclined position, the member 29 is held solely by the power of motor 35. This is possible inasmuch as the weight of the bill bundle 2 is minor and no forces are exerted on the member 29, either, during the step of removal via the opening 12. The withdrawal of the bill bundle 2 is detected, as illustrated in FIG. 10, by an electro-optic sensor 133 in the opening 12, which works together with the control system in the safe door 16. After removal of the bill bundle 2, the control system gets a signal from the optic sensor 133, and the control system gives a signal to the drive of the conveyor 15 (not shown) for the gear belt 132 to do an opposite rotation. The member 29 will be removed to its horizontal position, as shown in FIGS. 5*b* and 10. The unit 20 is again ready for receiving bill bundles 2.

In order to accommodate a strongbox 1 selected by the control system, the crank 31 is rotated downwards by the motor 35 over the drive shaft 33. into the position shown in FIG. 5*a* by about seven degrees past the position illustrated in FIG. 5*b*. The member 29 is still in the horizontal position since the rotation takes place about the bottom dead center. In this horizontal position, the fulcrum with the bolt 43 of the angle lever 32 and the crank 31 is located, as shown in FIG. 5*a*, slightly below the connecting line of the center of the drive shaft 33 and the center of bolt 44, i.e. the pivoting mechanism with crank 31 and angle lever 32 has just surpassed its bottom dead center position. However, the leg 57 has been moved upwards with its free end by the additional rotation, and presses the extension 129 upwardly with its end. Thereby the guide rail 122 is swung about its axis, constituted by the projections 130 supported in the blocks 131, i.e. the extension 123 is urged outwards, as shown in FIG. 7. The slide 77 on the underside 76 of member 29 is in a position in close proximity to the pivot axle 30.

The strongbox 1, selected by the control system, is pushed by the cross feed means 22 to the lifting means 23 and raised by the latter to underneath the member 29. Each of the strongboxes 1 has two eyes 82 in the vicinity of its outer bottom rim, as shown in FIG. 9 and described above. These two eyes 82 engage into the grippers 81 of the slide 77. The motor 35 turns both cranks 31, by means of the drive shaft 33, upwardly, the leg 57 exits from the extension 129. Each of the guide rails 122 is pulled, as shown in FIG. 6, by the spring 125 against the edge 41 and 42, respectively, whereby the strongbox 1 is held with its lateral protuberance 127 at the member 29 by the extension 123 of the guide rail 122. Inasmuch as this rotation takes place directly about the bottom dead center of the pivoting mechanism, the member 29 thus far has not performed a pivoting motion. Pivoting now commences gradually, and the motor 35 keeps turning until the top dead center position has been exceeded at an inclination of member 29 of about sixty degrees with respect to the horizontal, and the back of the knee 56 of the angle lever 32 lies on the drive shaft 33, as indicated in FIG. 5*d*. In this position the strongbox 1 is located below the opening 12, as shown in FIG. 1 and in FIG. 10 with dashed lines. The opening 12 is vacated by the slide 27, and the strongbox 1 is shifted, sliding on the guide rails 122, by the grippers 81 and the extension 79 at the slide 77 by the motor 65 via the shaft 30, the gear belt wheels 60-63, and the gear belts 66 and 67. As indicated in FIG. 10, additional rails 134 are arranged in the opening 12 below the latter, the protuberance 127 of the strongbox 1 continuing to slide in these rails as soon as the protuberance extends beyond the guide rails 122. The shifting of the slide 77 is stopped by the control system via the motor 65 as soon as strongbox 1 has entered the proximity of the top edge of member 29. The strongbox 1 protrudes at this point past the opening 12, and its contents are withdrawn by the teller. The weight of the strongbox 1, of the member 29, and a possible weight exerted by the teller during removal of the objects stored in the strongbox 1 urge the back of the knee 56 ever more strongly against the drive shaft 33; the member 29 remains automatically fixed in this position. Newly filled, or also empty, the same strongbox 1, which cannot be removed, is retracted by changing the rotation sense of the motor 65, the slide 27 is closed, and the member 29 is pivoted back by the motor 35 into the horizontal position shown in FIG. 5*a*, the guide rails 122 being opened again. The lifting means 23 receives the strongbox 1 for depositing same again in the storage chamber 21 of the storage means 5, by way of the cross feed mechanism 22. The pivotable member 29 and also the strongbox storage means 9 are designed so that strongboxes 1 can be utilized having a single and double filling level.

All deposits and withdrawals into and from the strongboxes 1 and of paper currency bills 2, as well as, inter alia, their value, are printed out, with bank customer data, in a journal printer in the door 16 of the safe.

The shifting of the strongboxes 1, which are heavy in some cases, through the opening 12, and also their reception by the lifting means 23 in the immediate vicinity of respectively one dead center position of the two cranks 31 and 32 has the advantage that holding forces for the motor 35 can be almost neglected, and the motion sequence of the member 29 from standstill commences without jerking.

The attachment of the gear belt wheels 61–63, of the gear wheel 96 with the gear belt wheel 97, as well as of the crank 31 on the axle 33 with pin and spring ring has proven itself well in the assembly, but could also be performed differently, for example also by means of split pins.

The slightly raised holddown means 103 during insertion of the bill bundle 2 from the collection box 19 to the topside 75 of the member 29 has likewise proven itself well; however, with a corresponding dimensioning of the diameter of the conveying rollers 109 and of the bias of spring 120, the lifting action could be omitted.

With a slight structural adaptation, it is also possible to utilize straps with an appropriate width in place of the three gear belts 101 and/or of the gear belt pairs 67 and 66.

I claim:

1. A device for depositing and dispensing of objects to be stored in boxes (1) and for dispensing of sheet-like material (2), comprising a housing (3) surrounding an interior space (4), said housing having an opening (12), first storage means (9) having a plurality of storage sites (21) therein, a plurality of boxes (1) inserted respectively in said plurality of storage sites (21) in said first storage means (9), second storage means (10) for storing said sheet-like material (2), an issuance and introduction unit (20) connected adjacent said opening (12) in said housing (3) for individually issuing and reintroducing said boxes (1) through said opening (12) and for issuing said sheet-like material (2) through said opening (12);

first conveying means (22, 23) for individually conveying said boxes (1) from said storage sites (21) of said storage means (9) to said issuance and introduction unit (20) and vice versa; second conveying means (15, 18) for conveying said sheet-like material (2) from said second storage means (10) to said issuance and introduction unit (20);

said issuance and introduction unit (20) having a support and guide member (29) being pivotally connected relative to said housing, first transfer means (66, 67) for transferring said boxes (1) from said first conveying means (22, 23) to said support and guide member (29) and along said member (29) and through said opening (12) in said housing (3) and vice versa, second transfer means (101) for transferring said sheet-like material (2) from said second conveying means (15, 18) to said support and guide member (29) and along said member (29) and through said opening (12) in said housing (3), said pivotal connection for pivoting said support and guide member (29) comprising a pivoting mechanism (31, 32) having a first position, in which first position said support and guide member (29) is in an approximately horizontal first position (FIGS. 5*a*, 5*b*), a second position, in which second position said support and guide member (29) is in a second position (FIG. 5*c*) tilted upwards with respect to said approximately horizontal first position and aligned with said opening (12) in said housing (3), and a third position, in which third position said support and guide member (29) is in a third position (FIG. 5*d*) tilted further upwards with respect to said second position (FIG. 5*c*) and aligned with said opening (12) in said housing (3), said support and guide member (29) having an underside (76), a topside (75) and opposite lateral sides, and including a pair of guide rails (122) respectively connected to the opposite lateral sides on the underside (76) of said support and guide member (29), said first transfer means (66, 67) including pushing means (77, 81) for pushing a said box (1) along the underside (76) of said support and guide member (29) and through said opening and for transferring back a said box, the box (1) pushed by said pushing means (77, 81) being engaged by and moved along said guide rails (122) on the underside (76) of said support and guide member (29), said second transfer means (101) comprising belt means including belt drive mechanism (101, 102, 99, 94), holddown means (103) arranged on the topside (75) of said support and guide member (29) and means resiliently urging said holddown means (103) downwards towards said belt means (101) of said belt drive mechanisms (101, 102, 99, 94), whereby both a single piece of sheet-like material (2) and a bundle of sheet-like material (2) are engageable between said holddown means (103) and said belt means (101) and transferred by said second transfer means (101) along the topside (75) of said support and guide member (29) and through said opening (12) and held in place until withdrawn from outside said housing (3), and said pivoting mechanism (31, 32) being in said first position, when a said box (1) or said sheet-like material (2) is transferred from said first or second conveying means (22, 23) towards said support and guide member (29) or vice versa, in said second position, when said sheet-like material (2) is transferred through said opening (12) in said housing (3) from the topside (75) of said support and guide member (29); and in said third position, when a said box (1) is transferred through said opening (12) in said housing (3) and vice versa from the underside (76) of said support and guide member (29);

so that both, said boxes (1) and said sheet-like material (2) are issued by said issuance and introduction unit (20) at the same site and in the same grasp position, protruding from said opening (12), wherein said box (1) or box content or sheet-like material (2), respectively, can be readily grasped from outside said housing (3).

2. A device according to claim 1, in which each of said guide rails (122) is pivotally connected to said support and guide member (29) for movement approximately perpendicular to the conveying direction of a said box (1) along said member (29), whereby a said box can be received from or transferred to said first conveying means (22, 23) by said support and guide member (29).

3. A device according to claim 1, including sealing means movably connected adjacent said opening 12 for sealing said opening.

4. A device according to claim 1, in which said pivoting mechanism (31, 32) having a first and a second dead center position, in said first dead center position said pivoting mechanism (31, 32) being in said first position and said support and guide member (29) is in an approximately horizontal position, and in said second dead center position said pivoting mechanism (31, 32) being in said third position and said support and guide member (29) is in a position above the horizontal position aligned with and beneath said opening (12) in the position for insertion and removal of objects into and from a box (1) on said member (29).

5. A device according to claim 4, including a drive shaft (33) supported on said issuance and introduction unit (20), said pivoting mechanism (31, 32) includes on each side of said support and guide member (29) a crank (31) and an angle lever (32), said crank (31) non-rotationally connected to said drive shaft (33), said angle lever (32) having one leg portion (34) having two ends and a knee portion (56), said one leg portion (34) pivotally connected at one end to the end of said crank (31) and at the other end to said support and guide member (29), whereby, after said support and guide member (29) is pivoted into the position for insertion and removal of objects into and from a box (1), said pivoting mechanism (31, 32) surpasses said second dead center position by several angular degrees, said knee portion (56) moves into a rest position on said drive shaft (33), whereby said support and guide member (29) is fixed in a self-holding position while a said box (1) thereon is transferred through and retracted into said opening (12).

6. A device according to claim 5, including an axle (130) pivotally connecting said pair of guide rails (122) to said support and guide member (29) for swinging movement in parallel to the transfer direction of said first transfer means (66, 67), resilient means (125) connected to resiliently retain each said guide rail (122) on the side of said member (29), said angle lever (32) having another leg portion (57), an extension (129) connected on each of said guide rails (122) and connected to be engaged by said another leg portion (57) after said support and guide member (29) is pivoted from the insertion and removal position into the horizontal position and said pivoting mechanism (31, 32) surpasses said first dead center position by several angular degrees, to swing each said guide rail (122) away from the sides of said support and guide member (29) to transfer a said box (1) to said first conveying means (22, 23) and to receive a said box (1) from said first conveying means (22, 23).

7. A device according to claim 1, said pushing means (77, 81) including a slide (77) with at least one gripper (81) for engaging a said box (1), said first transfer means (66, 67) including belt drive means (66, 67) on opposite sides of said support and guide member (29), and said slide (77) connected to said belt drive means (66, 67) to be moved thereby to move a said box (1) along said member (29).

8. A device according to claim 1, including at least two of said openings (12) at spaced apart positions in said housing (3), a respective said issuance and introduction unit (20) with a support and guide member (29) connected in said housing adjacent each of said at least two openings (12), whereby respective boxes (1) and respective sheet-like material (2) can be assigned to respectively one of several users of said device.

9. A device (3) according to claim 8, in which each opening (12) of said at least two openings (12) is associated with a data input facility (11), by means of which data stored in a control system can be called up, inter alia, for the functional sequence of the first conveying means (22, 23) and second conveying means (15, 18), of the first transfer means (66, 67) and second transfer means (101), and of the member (29), and data can be recorded concerning the issuance of the material (2) and the depositing and withdrawal of the objects stored and, respectively, to be stored in the boxes (1).

10. A device according to claim 8, including a slot (13) in said housing (3) for receipt of said sheet-like material (2), and means connected to reissue said latter material (2) through one of said openings (12).

* * * * *